US005099674A

United States Patent [19]

Nagel

[11] Patent Number: 5,099,674

[45] Date of Patent: Mar. 31, 1992

[54] METHOD AND APPARATUS FOR THE MANUFACTURE OF J-SHAPED DISPLAY HOOKS WITH BALLED ENDS

[75] Inventor: Thomas O. Nagel, Blairstown, N.J.

[73] Assignee: Trion Industries, Inc., Wilkes-Barre, Pa.

[21] Appl. No.: 578,584

[22] Filed: Sep. 6, 1990

[51] Int. Cl.[5] ..... B21F 45/00; B21F 5/00

[52] U.S. Cl. ..... 72/403; 72/217; 72/318; 72/294; 72/330; 140/80

[58] Field of Search ..... 72/403, 215-219, 72/388, 387, 330, 325, 318, 316, 322, 294; 140/80, 104, 102, 87; 29/7

[56] References Cited

U.S. PATENT DOCUMENTS

| | | | |
|---|---|---|---|
| 334,432 | 1/1886 | Hartz | 72/217 |
| 448,224 | 3/1891 | Glover | 29/7 |
| 517,775 | 4/1894 | Steinmann | 140/80 |
| 1,283,453 | 11/1918 | Barry | 72/330 |
| 1,583,321 | 5/1926 | Smith | 140/80 |
| 1,674,318 | 6/1928 | Carr | 72/322 |
| 1,936,611 | 11/1933 | Young | 72/403 |
| 1,956,756 | 5/1934 | Dillingham | 140/80 |
| 3,373,595 | 3/1968 | Harris | 72/403 |

*Primary Examiner*—Daniel C. Crane
*Attorney, Agent, or Firm*—Schweitzer Cornman & Gross

[57] ABSTRACT

A method and apparatus is disclosed for the manufacture of J-shaped display hooks with balled ends in a single manufacturing operation, without requiring separate handling of the display hook for the bending and ball-forming operations. A continuous length of wire is advanced incrementally and gripped tightly adjacent its forward end. The wire is severed by a cutting and forming bar, which also bends the base portion of the wire at right angles to the main axis of the wire. While the wire remains tightly gripped at its forward end, and continue to be supported adjacent its base by the cutting and forming bar, a ball-forming die is advanced against a projecting forward end of the wire, upsetting the wire end and forming an enlarged end of generally spherical configuration. Immediately thereafter, the wire is released at its forward end, and a rotary plate is actuated, causing a bend-forming element to travel through a generally circular path concentric to a cylindrical forming drum. This operation, which is carried out while the base portion of the wire remains locked in position, forms a generally semicircular bend in the previously balled end of the wire. Both the ball-forming operation and the hook-forming bend are carried out in sequence, while the remainder of the hook remains locked in position and oriented in a predetermined manner, so that the various elements of the resulting hook are properly shaped and aligned.

15 Claims, 2 Drawing Sheets

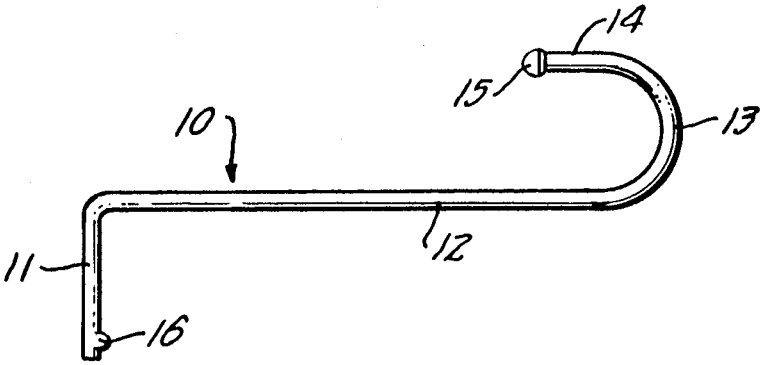
FIG. 1.
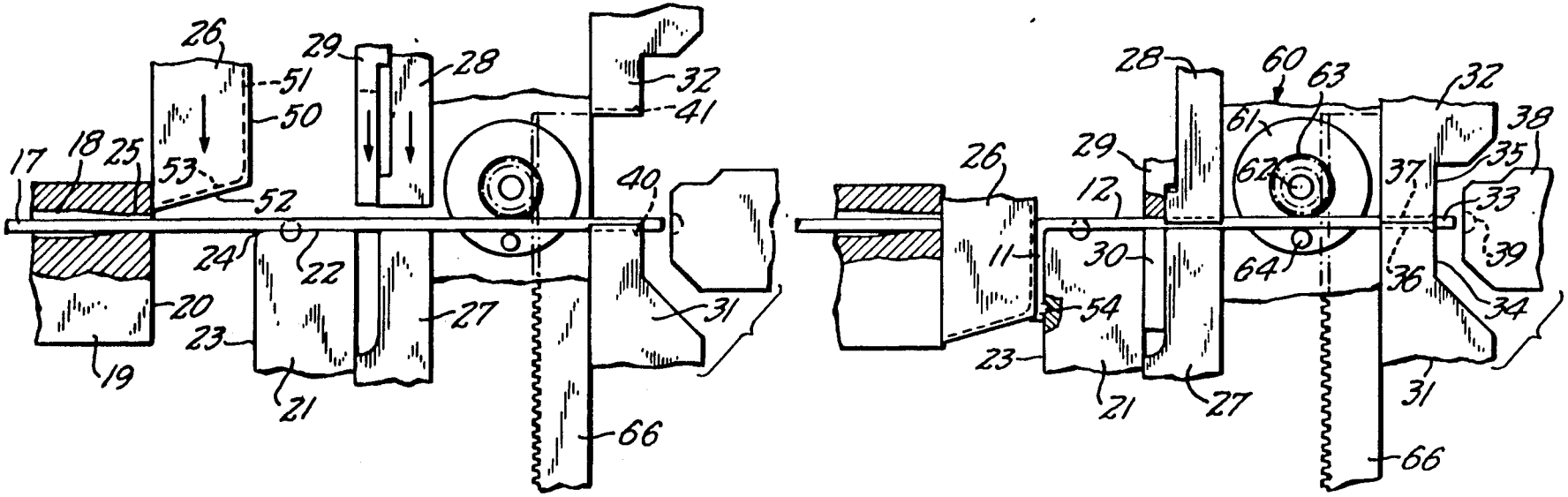
FIG. 2.
FIG. 3.

METHOD AND APPARATUS FOR THE MANUFACTURE OF J-SHAPED DISPLAY HOOKS WITH BALLED ENDS

BACKGROUND AND SUMMARY OF THE INVENTION

The present invention relates to display hooks for the display of carded merchandise and the like, and more particularly to improvements in hooks of this type that are formed in a J-shaped configuration. Especially, the invention is directed to J-shaped display hooks provided with balled ends for improved safety.

Formed wire display hooks are used extensively in connection with apertured panel board and shelf displays for hanging and displaying carded merchandise and the like. Because display hooks project outward toward the customer, and may come into contact with a customer passing by or reaching in for merchandise, it has become increasingly common to provide protection for the raw outer end extremity of the wire hook, so that the opportunity for injury is minimized. One of the common procedures for this purpose is the provision of a so-called balled end, which is formed by mechanically upsetting and deforming the cut-off outer end extremity of the wire, to provide an enlarged, more or less spherically contoured smooth outer end.

Certain types of display hooks, particularly those designed for mounting on the front edge of a display shelf, for example, tend to project substantially into the aisle space in front of the display area. Since display hooks used in this manner have increased possibility of accidental customer contact, it is known and common to form such hooks with a J-shaped configuration, so that the frontmost portion of the hook has a generously rounded contour of bent wire, and the raw end of the wire faces away from a customer standing in the aisle space. While forming the display hooks in a J-shaped configuration reorients and displaces the raw end extremity of the wire hook, there still is the possibility of undesired customer contact and possible scratching or other minor injury, as when a customer reaches in for a merchandise item and contacts the raw end of the wire while withdrawing his or her hand.

Because of the residual potential for contact with the raw end of the display hook, even with a J-shaped configuration, the desirability of providing a balled end on a J-shaped hook has been known. Nevertheless, rarely are such hooks provided with balled ends because of the significant extra expense that has been entailed in the manufacture of hooks to provide both a J-shaped configuration and a balled end. Heretofore, this has always required separate and independent manufacturing operations. Thus, it has been not cost effective, in the past, to provide both a J-shaped configuration and a balled end on a display hook, because the cost of the extra manufacturing steps made the article prohibitively expensive to the customer.

In accordance with the present invention, a novel method and apparatus is provided which enables a wire display hook element to be manufactured with both a J-shaped configuration and a balled end, in a single, sequential manufacturing operation, with virtually no increase in cost as compared to forming the hook by conventional means with either one but not both of the balled end or J-shaped features.

Pursuant to the invention, a novel method and apparatus is provided in which a generally continuous wire is incrementally advanced to present a predetermined length of wire into a position to be formed. Thereafter, a series of operations is performed in sequence, generally as follows: First, the wire is acted upon by a cutting and forming bar to sever the desired wire section from the continuous supply and, as part of a continuous operation, to bend the base portion of the wire to lie at a substantial angle to the principal wire axis. The cutting and forming bar then remains for a period of time in its extended position, to provide support and orientation for the wire section, as it undergoes further processing operations.

Following the cutting and bending operation, a forward end portion of the wire is tightly gripped by a pair of gripping dies, while a ball-forming die is advanced against the projecting forward end extremity of the wire, to form a balled end. Immediately thereafter, the forward gripping dies and the ball-forming die are retracted, to free the forward end portion of the wire section.

During the initial advance of the wire into forming position, the wire section is guided between a cylindrical supporting drum and a radius pin, which lie respectively above and below the wire. As soon as the forward gripping dyes and the ball-forming die have been retracted, the radius pin is actuated to move through a circular path concentric with the supporting drum, causing the forward portion of the wire to be bent first upwardly and then rearwardly about the supporting drum, through a bend of approximately 180°, to impart the desired J-shaped configuration to the hook. The balled end, previously formed on the straight wire, does not interfere with the process, as the radius pin has completed its bend-forming movements before it reaches the end extremity of the wire.

Because of the sequence in which the operations are performed, and the manner in which they are performed, it becomes economically realistic to provide both a J-shaped configuration and a balled end on a display hook device which can be marketed at a price attractive to the user. Particularly important is the fact that the hook element does not have to be separately handled, in order to provide both a J-shaped configuration and a balled end. Both operations are performed in rapid sequence, while the wire is being held fixed and oriented in the forming machine. When the wire is ejected from the forming machine, all of the operations have been performed, and the wire element is ready for assembly to its mounting base.

For a more complete understanding of the above and other features and advantages of the invention, reference should be made to the following detailed description of a preferred embodiment, and to the accompanying drawings.

DESCRIPTION OF THE DRAWINGS

FIG. 1 is a side elevational view of a wire display hook manufactured in accordance with the method and apparatus of the invention to incorporate a J-shaped configuration and a balled end.

FIGS. 2–7 are fragmentary illustrations showing a sequence of operations performed on a length of wire, pursuant to the invention, in order to form the hook of FIG. 1.

DESCRIPTION OF PREFERRED EMBODIMENTS

Figure 6:
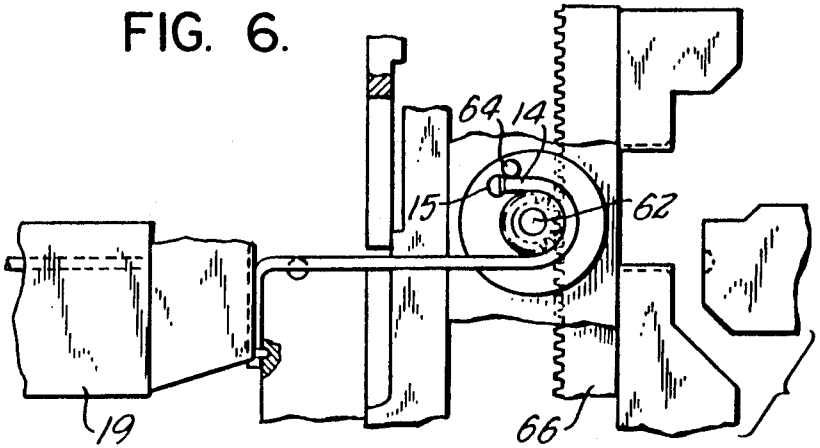

Referring now to the drawing, FIG. 1 illustrates a typical and advantageous form of display hook 10 manufactured in accordance with the method and apparatus of the invention. The hook 10 of the illustration is designed as a laterally swivelling hook, for mounting at the front edge of a merchandise display shelf, advantageously according to the teachings of the copending application of David R. Thalenfeld, Ser. No. 554 699, filed July 18, 1990. The principles of the invention are applicable, however, to a wide variety of hooks and are directed broadly to hooks provided with a J-shaped configuration and a balled end. The illustrated hook includes a base portion 11, generally vertically oriented, which joins with a generally horizontally oriented merchandise support portion 12. At its forward end, the hook is provided with a relatively large radius, semicircular end 13, which terminates in a short rearwardly directed portion 14 and, finally, in a balled end 15. In the illustrated device, a retention key 16 is provided near the lower end of the base portion 11.

With reference now to FIG. 2, the numeral 17 designates a generally continuous supply of wire of a diameter (e.g., ⅛ inch) suitable for the formation of a merchandise display hook. The wire is advanced intermittently through a passage 18 in a cutting die 19, exiting from the cutting face 20 of the die and projecting forward therefrom a predetermined, desired distance for the particular hook being formed. The means for advancing the wire are not illustrated, but are conventional and well known to those skilled in the art.

Spaced forwardly of the cutting face 20 of the cutting die 19 is a forming anvil 21, provided with a horizontal support surface 22 at its upper extremity, and a vertical support surface 23 spaced from and facing the surface 20 of the cutting die 19. The forming anvil also is provided at its upper rearward corner with an arcuate corner contour 24, suitable for forming a relatively sharp bend in the wire. The positioning of the forming anvil 21 is such that its upper support surface 22 is substantially aligned with the bottom of the wire 17 exiting from and projecting forward from the outlet 25 of the passage through the cutting die 19. The arrangement is such that the wire 17, as it is projected forwardly from the cutting die 19 is in a position to be supported by the surface 22 of the anvil.

A cutting and forming bar 26 is positioned normally above the axis of advance of the wire 17 and is aligned with the space between the cutting surface 20 and the forming surface 23 of the die 19 and anvil 21 respectively. The width of the cutting and forming bar, measured in the direction of the axis of the wire, is approximately equal to the space between the cutting and forming surfaces 20, 23, so that the bar 26 can be received relatively closely between the die 19 and anvil 21.

The forward facing surface 50 of the cutting and forming bar is provided with a vertical wire-receiving groove 51. Likewise, the downwardly angled bottom face 52 of the cutting and forming bar is provided with a wire-receiving groove 53 which lies in a vertical plane containing the axis of the wire 17. Accordingly, when the cutting and forming bar descends, the wire is initially received in the lower most end of the groove 53, immediately prior to the wire being severed by the downward shearing action of the cutting and forming bar against the front face 20 of the cutting die.

Following severing of the wire, and with continued downward movement of the cutting and forming bar, the wire is bent progressively downward, while being received first in the lower groove 53 and thereafter in the vertical groove 51. Upon completion of the full downward stroke of the cutting and forming bar 26, as shown in FIG. 3, the base portion 11 of the wire has been bent substantially at right angles to the principal axis of the wire and is tightly confined between the vertical groove 51 and the rear face 23 of the anvil 21. If the wire is provided with a retention key 16, as in the illustration of FIG. 1, the anvil 21 is provided with a suitable recess 54 for receiving the key when the base portion 11 is formed by the downward movement of the cutting and forming bar 26.

Positioned adjacent to and in front of the forming anvil is a lower gripping element 27 advantageously fixed in position, which cooperates with a movable upper gripping element 28. The set of gripping elements 27, 28 may be referred to, for convenience, as back gripping elements. Cooperating with the back gripping elements is a retractable wire guide 29, which is provided with a downwardly opening vertical slot 30 arranged to closely receive the wire 17. The slot 30 may be upwardly convergent, so as to be readily received over the wire 17 and, with continued downward movement of the guide member, is arranged to progressively more closely confine the wire until, in the final, downward position of the guide member 29 (see FIG. 3) the wire is closely confined therein against lateral movement. Desirably, the guide member 29 actuates slightly in advance of the movable upper gripping element 28, so that the wire element is properly confined and located laterally by the guide 29, before becoming tightly gripped between the back gripping elements 27, 28. Although it is not a critical feature of the invention, the guide element 29 and upper clamping element 28 advantageously are actuated in sequence by cam mechanisms or the like (not shown), which are conventional and well known to those skilled in the art.

Spaced forwardly of the back clamping elements 27, 28 is a set of front clamping elements 31, 32, of which the lower element 31 advantageously is fixed in position, while the upper clamping element 32 is vertically movable between clamping and retracted positions, shown in FIGS. 3 and 2 respectively.

To advantage, the front and back lower clamping elements 31, 27 are fixed in such positions that, when the wire 17 is intermittently advanced, the bottom surface of the wire moves over the top of and, substantially in contact with the upper surfaces of the fixed lower gripping elements. The wire is thus supported the lower gripping elements prior to the closing of the movable upper gripping elements 28, 32.

Pursuant to the invention, the positioning of the forward gripping elements 31, 32 is such that, after an intermittent advancement of a predetermined length of wire, a short, predetermined length of wire 33 remains projected forwardly from the front surfaces 34, 35 respectively of the front gripping elements. This projecting length 33 provides the material for forming of the balled enlargement 15.

As reflected in the drawings, at least the forward gripping elements 31, 32 are provided with wire-receiving grooves 36, 37 arranged to closely receive the projected wire, so that the same may be very tightly and effectively gripped between the closed upper and lower gripping elements 32, 31.

Positioned directly in front of the gripping elements 31, 32 is a ball-forming die 38, provided in its rearwardly facing end with a semi-spherical recess 39 coaxially aligned with the projecting end 33 of the wire. With the wire properly gripped and supported, as will be hereinafter more fully described, the ball-forming die 38 is advanced rearwardly, crushing the projecting end 33 of the wire and, by means of the semi-spherical recess 39. forming it into a generally spherically configured enlargement. To this end, the forward extremities of the gripping element recesses 36, 37 are spherically contoured, as at 40, 41 (see FIG. 2), enabling some of the deformed metal of the wire end extremity 33 to be compressed into the recesses 40, 41 of the gripping elements, as well as into the recess 39 of the ball-forming die.

Importantly, the cutting and forming bar 26 remains in its lowered position during the ball-forming operation. This provides a positive base against which the ball-forming die 38 can react. The front gripping elements 31, 32 constitute a primary means of holding the wire during the ball-forming operation. Nevertheless, the positive columnar support provided by the cutting and forming bar 26 is significantly beneficial, in view of the substantial forces involved in crushing of the end of the wire to form the balled end. Further, in this respect, the positioning of the back gripping elements 27, 28, intermediate the forward and rearward ends of the straight wire section 12 (FIG. 3) assists importantly in maintaining the wire in column during the ball-forming step, so that forces can be properly absorbed by the cutting and forming bar 26.

Positioned between the front and back gripping elements is a hook-forming section 60, comprising a rotary plate 61 mounted to one side of the axis of the wire, for rotation about a horizontal axis 62 exposed at right angles to and above the axis of the wire. A cylindrical forming drum 63 is mounted coaxially with the rotary plate 61, conveniently being rotatable therewith, although the drum 63 may be non-rotatably mounted where desired. The location of the axis 62 is such that the lower extremity of the cylindrical forming drum 63 lies immediately above the upper surface of the wire, as shown in the drawings. The diameter of the drum 63 is selected to be appropriate to form the inside diameter of the semicircular bend 13 formed in the hook member, as indicated in FIG. 1. In one advantageous embodiment, for example, the forming drum 63 has a diameter of approximately 0.870 inches.

Fixed to the rotary plate 61 and extending outwardly therefrom directly below the wire is a radius pin 64. In the starting position of the apparatus, the radius pin 64 is positioned vertically below the lower surface of the forming drum 63 a distance just slightly greater than the diameter of the wire 17 such that, as the wire is incrementally projected forward into cutting and forming position, the advancing lead end of the wire is able to pass between the radius pin 64 and the forming drum 63 as it moves into its fully projected position.

Figure 7:
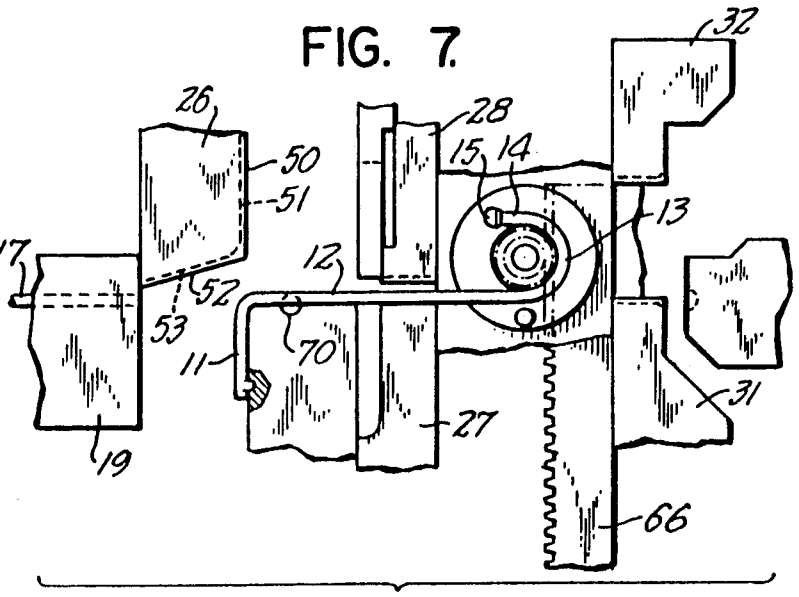
Figure 4:
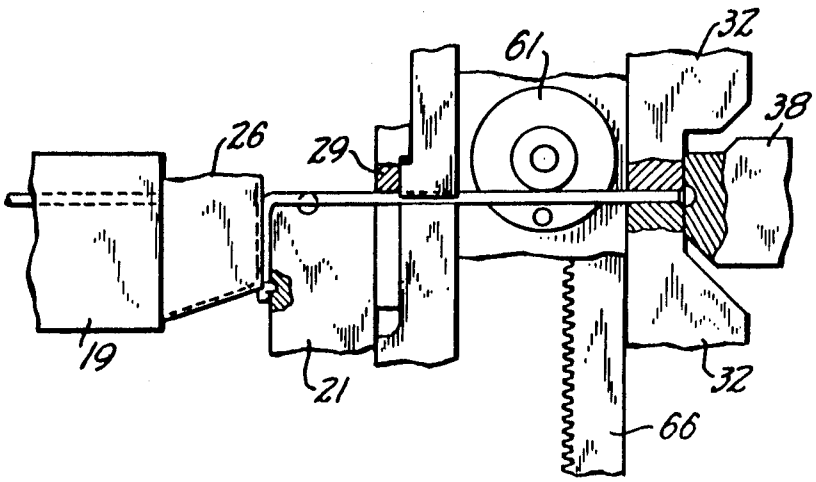
Figure 5:
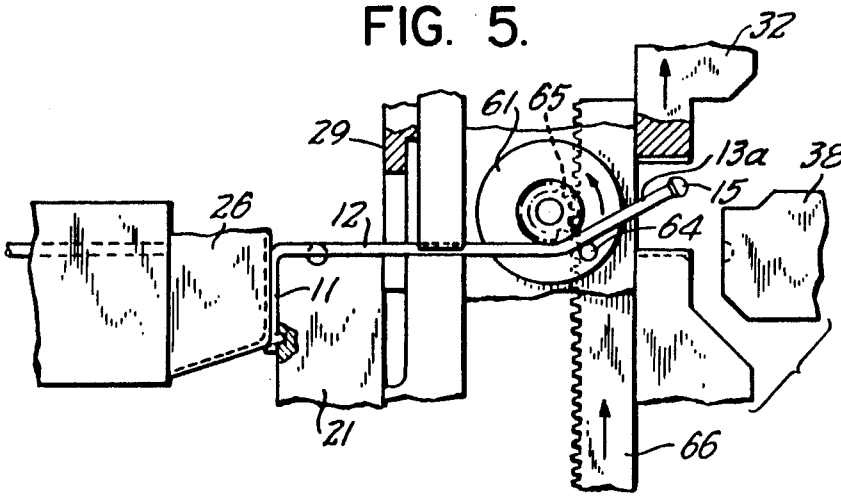

After formation of the balled end, as reflected in FIGS. 3 and 4 of the drawing, the elements of the apparatus are actuated to form the end of the wire into the desired J-shaped configuration. This is indicated in FIGS. 5–7 of the drawing, which illustrate the operations in sequence. Thus, immediately after forming of the balled end 15, the ball-forming die 38 is retracted to the right, and the upper forward gripping element 32 is retracted vertically upward, as shown in FIG. 5. At the same time, the guide element 29 may also be retracted, as its function has been completed and its operating stroke is relatively lengthy. As the forward gripping element 32 clears out of the way in an upward direction, the rotatable plate 61 and the radius pin 64 mounted thereon commence rotation in a counterclockwise direction. For this purpose, the plate 61 advantageously is fixed to a spur gear 65 (see FIG. 5) which is engaged with a rack element 66 which is actuated at this time to move in an upward direction through a predetermined (typically cam-controlled) operating stroke to rotate the plate 61 and pin in a counterclockwise direction. As the radius pin 64 moves through a counterclockwise arcuate path, it engages and forces upwardly and then rearwardly the projecting end 13*a* (FIG. 5) of the wire, causing it to be progressively bent around and in conformity with the cylindrical outer surface of the forming drum 63. This sequence is shown particularly in FIGS. 5 and 6 of the drawing.

While the hook-forming operation is under way, the base portion 11 of the wire remains held firmly fixed in position by the cutting and forming bar 26. This not only positively orients the elements of the wire, so that the J-shaped hook portion is formed in the same vertical plane as the downwardly extending base portion 11, but also the wire is locked against any tendency to move forwardly during the bending operation by reason of the base portion 11 being tightly locked between the cutting and forming bar 26 and the anvil 21.

To particular advantage, the dimensioning of the projected wire segment is such that an end portion of the wire, identified in FIG. 6 by the reference numeral 14, after forming of a semicircular bend in the wire, projects rearward beyond a vertical line extending from the axis 62 of rotation of the radius pin 64. This enables rotation of the radius pin throughout an angle somewhat greater than 180°, as reflected in FIG. 6, enabling the now rearwardly directed extremity of the wire end to be bent slightly downward, before the radius pin 64 engages the balled end 15. This allows for a slight amount of spring back in the wire, when the bending force is released by reverse rotation of the plate 61, that the resulting bend is approximately 180°.

After completion of the upward stroke of the rack 66, to the position shown in FIG. 6, the cutting and forming bar 26 can be retracted, along with the back gripping element 32 and the rack 66. The hook member is now free to be removed from the apparatus, and this advantageously is accomplished by extension of an ejecting pin 70, which is extended serves to eject the formed and completed hook laterally out of the apparatus, allowing it to drop into an appropriate collection bin (not shown).

Of particular significance, the display hook element can be processed to provide both a J-shaped configuration and a balled end, with a single processing of the element. Because of the particular sequence of operations performed, and the manner in which they are performed, the bending of the hook into a J-shaped configuration can follow immediately after the formation of a balled end, while the wire remains precisely gripped and oriented. Moreover, the manner in which the J-shaped configuration is imparted to the hook is such that the balled end does not interfere in any way therewith. The wire is initially engaged at a point remote from the balled end by means of a radius pin, which is carried in a circular path, travelling toward the balled end, causing the wire to be progressively conformed to the outer surface of a cylindrical forming drum. The radius pin during this forming process, slides progressively forwardly along the wire, until it reaches the previously formed balled end portion of the wire, at which time the bend forming operation has been completed.

In the past, it has been deemed not practicable to form a balled end in a J-shaped configuration in a single manufacturing operation. Conventional practice has been to perform each function in a separate operation, which requires an extra handling of the part. Each such extra handling of the part adds several cents to the cost of manufacture of the item, and because of the extremely cost competitive nature of such products, adding a few cents to the cost of manufacture effectively makes a product nonacceptable in the marketplace to large classes of customers.

Pursuant to the present invention, however, all of the manufacturing operations are carried out in rapid sequence, following incremental advancement of a predetermined length of wire into working position in the apparatus. First, the wire is severed and bent at the base by a cutting and forming bar, which thereafter serves to both orient and support the wire throughout the remainder of the operations. The wire at this stage is gripped tightly adjacent its forward end, to enable a ball-forming die to be advanced against the forward extremity of the wire and crush the projecting extremity into a generally spherical contour. During the application of this crushing force, the wire is supported as a column by the continued presence of the cutting and forming bar, which rigidly supports the base end of the wire. This is in addition to the gripping of the wire adjacent its forward end extremity. Further, the wire section is kept straight and in column during this procedure, by a set of back gripping elements 27, 28, which contain the wire in rigid alignment with its axes. Likewise, the cylindrical forming drum 63 and the radius pin 64 confine the wire from above and below and thus also assist in maintaining the wire in column during the ball-forming operation.

By enabling ball-forming and hook-forming operations to be accomplished in a single handling of the product, it is now possible to market a balled-end J-shaped hook at prices which are wholly competitive with prices of conventional J-shaped hooks without balled ends. This represents a significant advance in the art of display hook manufacture, which enables and encourages merchandisers to furnish their displays with greater regard to safety considerations.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention. Throughout the specification, and in the claims as well, reference to specific directions or orientations, such as "above", "below", etc., are intended only to facilitate understanding and it will be understood that the equipment may be differently oriented without in any way imposing a limitation on the scope of the invention.

I claim:

1. The method of making a J-shaped merchandise display hook with a balled end, which comprises (a) incrementally advancing a length of hook-forming wire a predetermined distance along its axis to project a length of wire suitable for forming a display hook of desired size and shape, (b) supporting a base end portion of said wire length between a cutting die and a forming anvil, (c) while so supporting said wire, moving a cutting and forming bar laterally toward and through the wire axis and between said cutting die and forming anvil to sequentially sever said wire at its base end portion and to bend said base end portion downward about said anvil to lie at a large angle to said axis, (d) the bent base end portion of said wire and the remaining forward portion thereof defining a working plane, (e) simultaneously (i) gripping portions of said wire adjacent its forward end extremity and (ii) supporting the bent base end portion of said wire against rearward axial movement by means of said forming bar, (f) while so gripping and supporting said wire, acting upon a projected forward end extremity of said wire to form a balled end thereon, (g) engaging said wire between a supporting drum of predetermined diameter, above the wire, and a radius pin, below the wire, (h) said drum having a central axis disposed at right angles to said working plane, and (i) causing said radius pin to move in a circular path about said central axis through an angle of at least about 180°, moving in a direction from the base end and toward the forward end of said wire, to form a U-shaped, upward and rearward bend in the forward portion of said wire, (j) said bend lying substantially in said working plane.

2. A method according to claim 1, further characterized by, (a) continuing to support the bent base end portion of said wire by means of said forming bar during the formation of said U-shaped bend in the forward portion of said wire.

3. A method according to claim 1, further characterized by, (a) said wire being gripped during the forming of said balled end, in one position adjacent its forward extremity in front of said drum and radius pin, and in a second position between said drum and the bent base portion of said wire.

4. The method of making a J-shaped merchandise display hook with a balled end, which comprises (a) incrementally advancing a length of hook-forming wire a predetermined distance along its axis to project a length of wire suitable for forming a display hook of desired size and shape, (b) supporting a base end portion of said wire length between a cutting die and a forming anvil, (c) gripping spaced apart portions of said wire in regions located respectively forward of said base end portion and adjacent the forward end extremity of said wire, (d) while so gripping said wire, acting upon a projected forward end extremity of said wire to form a balled end thereon, (g) engaging said wire, in the region between said spaced-apart gripped portions, between a supporting drum of predetermined diameter, positioned above the wire, and a radius pin, positioned below the wire, (h) said drum having a central axis being disposed at right angles to the axis of said wire, and (i) causing said radius pin to move in a circular path about said central axis through an angle of at least about 180°, moving in a direction from the base end and toward the forward end of said wire, to form a U-shaped, upward and rearward bend in the forward portion of said wire.

5. A method according to claim 4, further characterized by, (a) the base end portion of said wire being cut and bent downward at a large angle to the axis of said wire in advance of forming said balled end.

6. A method according to claim 5, further characterized by, (a) the base end portion of said wire and said U-shaped bend being formed in a common plane on opposite sides of the axis of said wire.

7. Apparatus for high production manufacture of J-shaped merchandise display hooks with a balled end, which comprises (a) means for incrementally advancing a length of hook-forming wire through a predetermined distance along its axis to project a length of wire suitable for forming a display hook of desired size and shape, (b) a cutting die member having an opening therein receiving said wire and through which said wire is projected, (c) a bend-forming anvil member mounted in fixed relation to said cutting die member and spaced forwardly thereof, (d) a top of said anvil member being positioned slightly below the axis of said wire, in position to support the wire during its advance and during operations performed thereafter, (e) a cutting and forming bar mounted for movement at right angles to the axis of said wire and movable through said axis and into the space between said cutting die and said forming anvil, sequentially severing said wire at its base end extremity and bending the base end portion of said wire at a large angle to the axis of the wire, (f) a pair of separable forward gripping dies positioned closely adjacent a forward end extremity of the projected length of wire and being movable into tight gripping relation to said wire while leaving a short exposed wire portion at the forward extremity, (g) a ball-forming die movable axially of said wire into metal-deforming contact with the forward end extremity thereof while said wire remains gripped by said forward gripping dies, (h) a rotary forming means mounted for rotation about a central axis oriented at right angles to the axis of said wire and offset above said axis, (i) said rotary forming means including a generally cylindrical supporting drum located on said central axis and positioned substantially in contact with the top portions of said wire, (j) said rotary forming means further including a radius pin, mounted for rotation in a circular path concentric with said central axis and spaced from said supporting drum a distance slightly greater than the diameter of the wire, and (k) means for rotating said radius pin to cause movement of said pin in a direction toward the forward end of said wire to form a U-shaped bend in the forward portion of said wire, and (l) means for holding the base portions of said wire during rotating of said radius pin.

8. Apparatus according to claim 7, further characterized by (a) at least one of said cutting and forming bar and said anvil member having a groove for the reception and orientation of said base end portion during operation of said rotary forming means.

9. Apparatus according to claim 7, further characterized by (a) a second set of gripping dies positioned to engage said wire between said base end portion and said rotary forming means during actuation of said ball-forming die.

10. Apparatus according to claim 7, further characterized by (a) means for sequentially retracting said forward gripping dies and actuating said rotary forming means.

11. Apparatus for high production manufacture of J-shaped merchandise display hooks with a balled end, which comprises (a) means for incrementally advancing a length of hook-forming wire through a predetermined distance along its axis to project a length of wire suitable for forming a display hook of desired size and shape, (b) means for cutting said wire and means for bending a base portion thereof at a large angle to the axis of advance of the wire, (c) said means for bending including a bend-forming anvil member about which said base portion is bent, (d) a pair of separable forward gripping dies positioned closely adjacent a forward end extremity of the projected length of wire and being movable into tight gripping relation to said wire while leaving a short exposed wire portion at the forward extremity, (e) a ball-forming die movable axially of said wire into metal-deforming contact with the forward end extremity thereof while said wire remains gripped by said forward gripping dies, (f) a member engageable with said base portion during operation of said ball-forming die for partially supporting said wire in columnar fashion against the impact of said ball-forming die, (g) means for engaging said wire rearwardly of the balled end thereof and operative to bend the forward portion of said wire in a generally upward and rearward direction in a generally J-shaped configuration, (h) means for gripping rearward portions of said length of wire during said last-mentioned bending operation, (i) said means for gripping including said anvil member.

12. Apparatus according to claim 11, further characterized by, (a) said means for bending the forward portion of said wire comprising a generally cylindrical bend-forming member engaging the top portion of said wire and a bending element movable in a generally circular path about the axis of said bend-forming member, 13. Apparatus according to claim 12, further characterized by, (a) said cylindrical bend-forming member and said bending element being mounted for rotation about a common axis.

14. A process according to claim 13, further characterized by (a) said bending element comprising a rotary plate and a radius pin mounted on said plate, (b) said radius pin being rotatable with said rotary plate through an angle in excess of 180°.

15. Apparatus according to claim 11, further characterized by, (a) said means for cutting and means for bending including a cutting and forming bar movable at right angles to the axis of said wire, (b) a cutting die positioned in predetermined spaced relation to said anvil member, for the close reception of said cutting and forming bar, (c) means for extending said bar to effect cutting and bending of said wire, and (d) means for retracting said bar after bending of the forward portion of said wire.

* * * * *